US007734238B2

(12) United States Patent
Takahashi

(10) Patent No.: US 7,734,238 B2
(45) Date of Patent: Jun. 8, 2010

(54) IMAGE FORMING APPARATUS WITH FIRST AND SECOND GUIDING SECTIONS FOR VARYING A CONTACT LENGTH OF A SHEET WITH A HEATING MEMBER IN ACCORDANCE WITH A THICKNESS OF THE SHEET

(75) Inventor: Hironori Takahashi, Osaka (JP)

(73) Assignee: Kyocera Mita Corporation (JP)

( * ) Notice: Subject to any disclaimer, the term of this patent is extended or adjusted under 35 U.S.C. 154(b) by 720 days.

(21) Appl. No.: 11/447,796

(22) Filed: Jun. 6, 2006

(65) Prior Publication Data

US 2006/0291915 A1 Dec. 28, 2006

(30) Foreign Application Priority Data

Jun. 28, 2005 (JP) ..... 2005-187613

(51) Int. Cl.
*G03G 15/20* (2006.01)

(52) U.S. Cl. ..... 399/322; 399/68

(58) Field of Classification Search ..... 399/68, 399/322, 323

See application file for complete search history.

(56) References Cited

U.S. PATENT DOCUMENTS 5,151,742 A * 9/1992 Yamaguchi ..... 399/323
5,708,946 A * 1/1998 Cahill et al. ..... 399/323
5,893,019 A * 4/1999 Yoda et al.
7,474,870 B2 * 1/2009 Kim et al. ..... 399/322

FOREIGN PATENT DOCUMENTS

JP 02143282 A * 6/1990
JP 04280280 A * 10/1992
JP 05165357 A * 7/1993
JP 9-114153 5/1997

* cited by examiner

*Primary Examiner*—David M Gray
*Assistant Examiner*—Laura K Roth
(74) *Attorney, Agent, or Firm*—Gerald E. Hespos; Michael J. Porco

(57) ABSTRACT

An image forming apparatus includes a fixing section and a guiding section. The guiding section includes first and second guiding members. The first guiding member is in a first conveyance path for a first recording sheet having a first width and contacts the first recording sheet to guide the first recording sheet to a discharging portion. The second guiding member is in an area of a second conveyance path a the second recording sheet having a second width larger than the first width and guides the second recording sheet to the discharge portion at an angle so that a contact length of the second recording sheet with the heating member along a conveyance direction of the second recording sheet is shorter than a contact length of the first recording sheet with the heating member along a conveyance direction of the first recording sheet.

12 Claims, 6 Drawing Sheets

IMAGE FORMING APPARATUS WITH FIRST AND SECOND GUIDING SECTIONS FOR VARYING A CONTACT LENGTH OF A SHEET WITH A HEATING MEMBER IN ACCORDANCE WITH A THICKNESS OF THE SHEET

BACKGROUND OF THE INVENTION

1. Field of the Invention

The present invention relates to image forming apparatuses such as a printer, a copying machine, a facsimile machine and a composite machine including functions of a printer, a copying machine and a facsimile machine. Particularly, it relates to an image forming apparatus comprising a fixing device.

2. Description of the Related Art

Conventionally, as the image forming apparatuses described above, the one disclosed in Japanese Unexamined Patent Publication No. 9-114153 is known. This image forming apparatus comprises a fixing section. The fixing section includes a heating member and a pressing member. A recording sheet, such as a pasteboard-like postcard and an A4-sized standard paper sheet, is nipped between the heating member and a pressing member, and then a toner image is heat-fixed on the recording sheet. Between the fixing section and a discharge portion at a downstream of the fixing section, a guiding member is provided. The guiding member guides the recording sheet from the fixing section to the discharge portion.

In the fixing section, the heating member consists of a heat roller and the like. A favorable heat-fixing is realized by adjusting a temperature of the heating member to an appropriate temperature. Too low a temperature of the heating member causes a fixing defect. On the contrary, too high a temperature of the heating member (for example, 195 degrees Celsius) decreases viscosity of toner particles on a recording sheet, which causes a likelihood that the toner particles are transferred to the heating member. Toner particles transferred to the heating member as described above are adhered to other recording sheet after one rotation of the heating member and thereby contaminates the recording sheet. Namely, it produces an offset phenomenon.

A favorable range of a temperature of the heating member is restricted. For example, transference of an image to an A4-sized regular recording sheet requires the restriction of the target temperature of the heating member within a range from 180 to 190 degrees Celsius. In addition, this range is applicable only for a heat-fixing to a recording sheet having a certain thickness. Different thicknesses of recording sheets prefer different temperatures of the heating member. For example, even if the heating temperature is set within the range described above, in the case where a heat-fixing is performed with that temperature to a recording sheet having a large thickness (for example, a cardboard-like postcard), an adherence of toner particles after the heat-fixing is lowered, in other words, an insufficient fixation occurs. This is because a large thickness of a recording sheet suppresses an elevation of the temperature of the recording sheet.

Such disadvantage might be avoided by changing a temperature of the heating member in accordance with a kind of the recording sheet, namely, setting the temperature higher than usual for a heat-fixing on a relatively thick recording sheet. However, such management of the temperature of the heating member is laborious. Further, if a heat-fixing is applied to a thin recording sheet having a large width at a temperature which has not been reached down to a predetermined level from once raised level, a disadvantageous occurrence of an offset may be caused.

SUMMARY OF THE INVENTION

To solve the problems described above, inventors of the present invention focused attention on a relationship between a thickness and width of a generally used recording sheet. Specifically, most recording sheets which are thicker than normal recording sheets and are used generally are narrower recording sheets than the normal recording sheets, e.g. postcards. This means that, in general, a thick recording sheet has a small width. Therefore, changing a mode of heating a recording sheet according to the width of the recording sheet can perform a desirable heat-fixing processing corresponding to the thickness of the recording sheet without changing a temperature of a heating member.

The present invention is made in view of the circumstances described above and includes a guiding section for guiding the recording sheet on which a heat-fixing has been applied in the fixing section to a predetermined discharge portion. The guiding section includes a first guiding member and a second guiding member. Herein, the first guiding member is provided in a first conveyance path for a first recording sheet having a first width and comes in contact with the first recording sheet to thereby guide the first recording sheet to the discharge portion. On the other hand, the second guiding member is provided in an area of a second conveyance path for a second recording sheet having a second width larger than the first width excluding the first conveyance path and comes in contact with the second recording sheet to thereby guide the second recording sheet to the discharge portion in such an angle that a contact length of the second recording sheet with the heating member along a conveyance direction of the second recording sheet is shorter than a contact length of the first recording sheet with the heating member along a conveyance direction of the first recording sheet.

Such a difference between said two contact lengths allows more heat to be applied to the first recording sheet than to the second recording sheet without changing a heating temperature of the heating member.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Hereinafter, a preferred embodiment of the present invention is described in detail with reference to the drawings.

Figure 1:
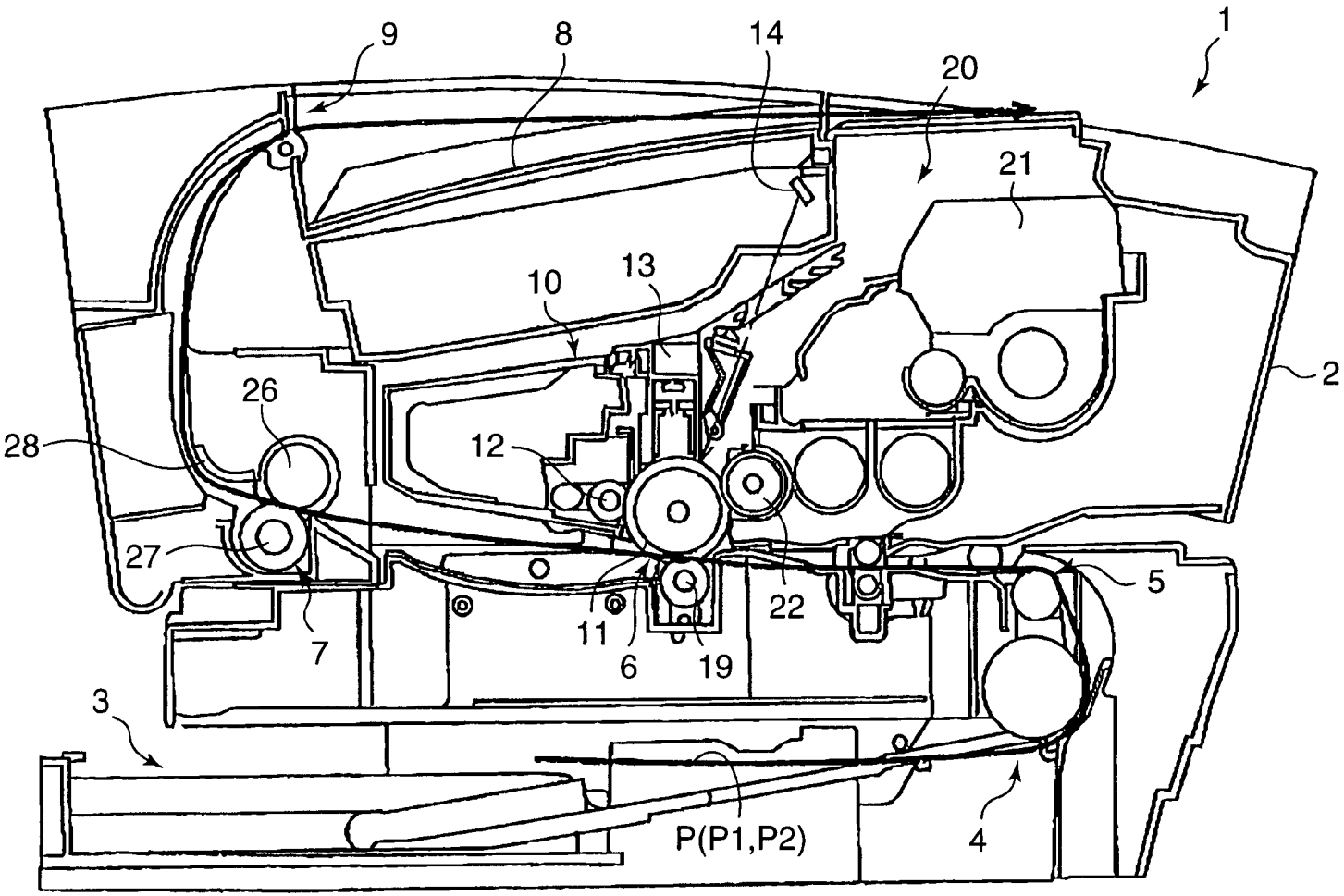
FIG. 1 is a side sectional view of an image forming apparatus according to an embodiment of the present invention.

FIG. 1 is a side sectional view schematically showing an image forming apparatus 1 according to the embodiment of the present invention. The image forming apparatus 1 includes a rectangular box-shaped apparatus main body 2. The image forming apparatus 1 includes in the apparatus main body 2 a sheet feeding section 4 for sending out a recording sheet P from a sheet feeding tray 3, a sheet conveyance path 5 for conveying the recording sheet P from the sheet feeding section 4, an image forming section 6 for transferring a toner image on the recording sheet P conveyed through the sheet conveyance path 5, a fixing section 7 for heat-fixing the toner image transferred by the image forming section 6 on the recording sheet P and a sheet discharge portion 9 for discharging the recording sheet P with the toner image fixed in the fixing section 7 to a discharge tray 8 provided at an exterior portion of the apparatus main body 2.

For the image forming apparatus 1, a first recording sheet P1 and a second recording sheet P2 are both used as the recording sheets P. The first recording sheet P1 is a recording sheet having a small width (first width) and a large thickness (first thickness), e.g. a postcard. On the other hand, the second recording sheet P2 is a recording sheet having a second width larger than the first width and a thickness smaller than the first thickness, e.g., a normal A4-sized recording sheet and the like.

The image forming section 6 includes a drum unit 10 having a photoconductive drum 11, a developing unit 20 having a developing sleeve 22 and a transferring roller 19 for transferring a toner image formed on the photoconductive drum 11 to the recording sheet P. In a position opposite to the developing sleeve 22 of the developing unit 20, a toner container 21 for storing toner particles including Magnetic substances is provided. The developing sleeve 22 is adapted for providing toner particles to thereby develop an electrostatic latent image formed on the photoconductive drum 11.

Around the photoconductive drum 11, a cleaner 12 for removing toner particles remained on a peripheral surface of the photoconductive drum 11, a charging device 13 for charging the peripheral surface of the photoconductive drum 11 uniformly and an electricity removing device (unillustrated) adapted for removing an electricity resided on the peripheral surface of the photoconductive drum are provided. Further, in the apparatus main body 1, there is provided an exposing device 14 for irradiating a laser light ray to the photoconductive drum 11.

The fixing section 7 includes a heating member 26 and a pressing member 27. The heating member 26 and the pressing member 27 of the fixing section 7 nip the first or second recording sheet P1 or P2 therebetween to thereby fix a toner image onto the first or second recording sheet P1 or P2.

In the apparatus shown in FIG. 1, the heat member 26 is a driving heat roller, and the pressing member 27 is a driven pressing roller. However, the heating member in the present invention is not limited to the heating member 26 shown in FIG. 1 but may be one which includes , for example, a heating member having a fixing roller which comes in contact with a pressing roller, a heat roller positioned apart from the pressing roller and a belt which connects the fixing roller and the heat roller to thereby transmit a heat from the heat roller to the fixing roller through the belt. Also, the pressing member in the present invention is not limited to the one shown in FIG. 1. For example, the pressing member may be one which has a pad that comes in contact with the heating member and a belt which is rotated about the pad.

In the sheet conveyance path 5 at downstream of the heating member 26, there is provided a guiding section 28. The guiding section 28 upwardly guides the recording sheet P on which a heat-fixing has been applied toward the discharge portion 9. The guiding section 28 includes a first guiding member and a second guiding member. The first guiding member consists of a plurality of guiding plates 29A as shown in FIGS. 2 to 4, and the second guiding member consists of a plurality of guiding plates 29B as shown in FIGS. 2 to 4.

The guiding plates 29A and 29B are provided at a level closer to the heating member 26 than to the pressing member 27 (upper side in Figures). The guiding plates 29A and 29B are aligned at a predetermined interval in a width direction in such a manner that the thickness direction of the guiding plates 29A and 29B is in conformity with the width direction of the recording sheet P.

Figure 4A:
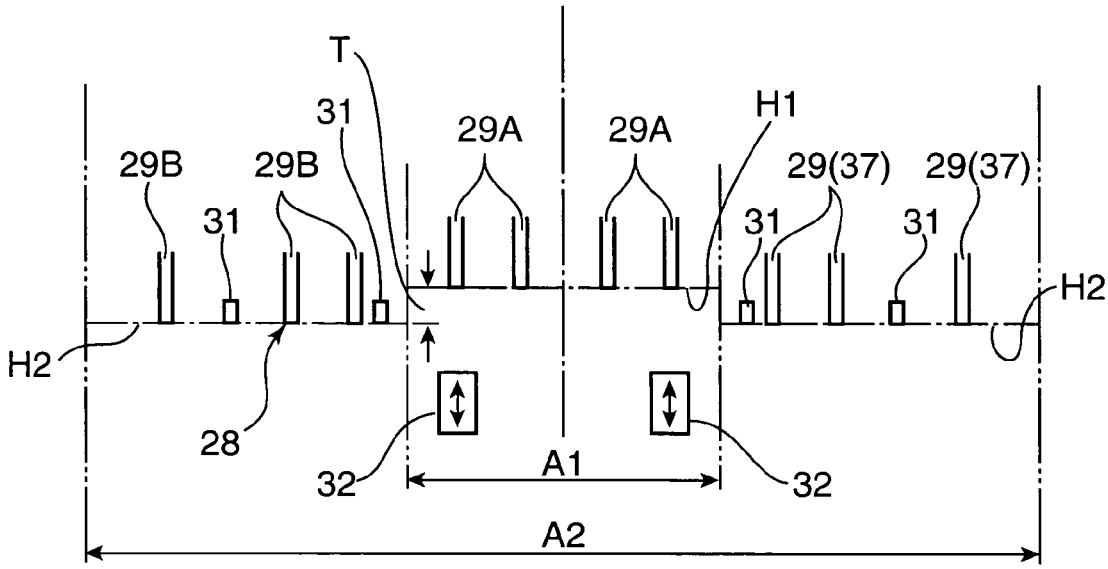
FIG. 4A is a front view showing a positional relationship of the guiding member, a separating claw and the deflecting member.

Among the guiding plates 29A and 29B, the first guiding plates 29A constituting the first guiding member are provided in an area A1 shown in FIG. 4A. The area A1 is in a central portion in a direction of a width of the recording sheet P and is occupied by a first conveyance path for the first recording sheet P1. On the other hand, the guiding plates 29B constituting the second guiding member are provided in an area A2 shown in FIG. 4A excluding the area A1. Namely, the guiding plates 29B are provided in outside areas at the both sides of the area A1. The area A2 is an area occupied by a second conveyance path for the second recording sheet P2.

Figures 2A, 2B:
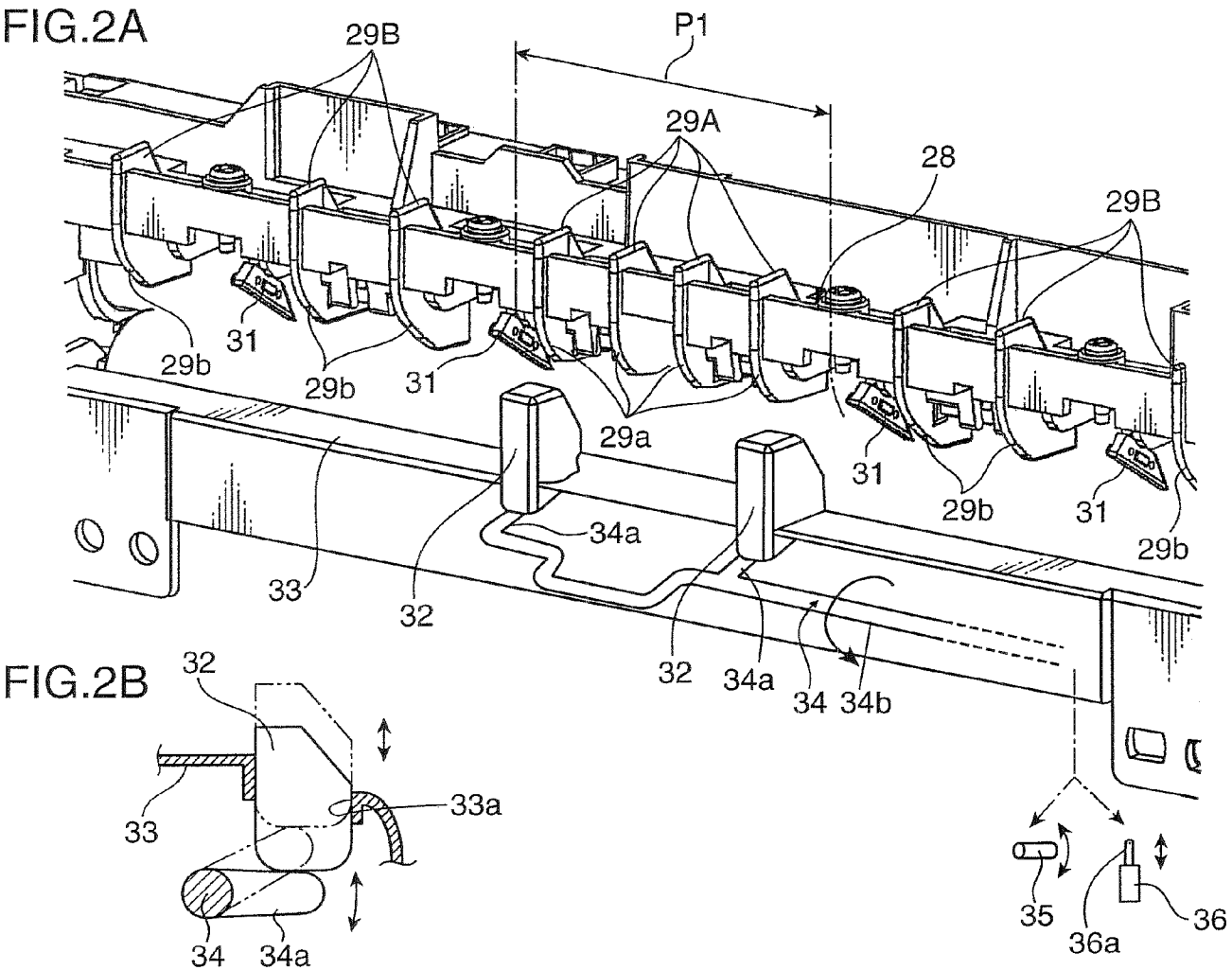
FIG. 2A is a perspective view showing a positional relationship of a guiding member, a separating member and a deflecting member.
FIG. 2B is a side view showing a relationship between the deflecting member and a lever of an operating shaft.
Figure 3:
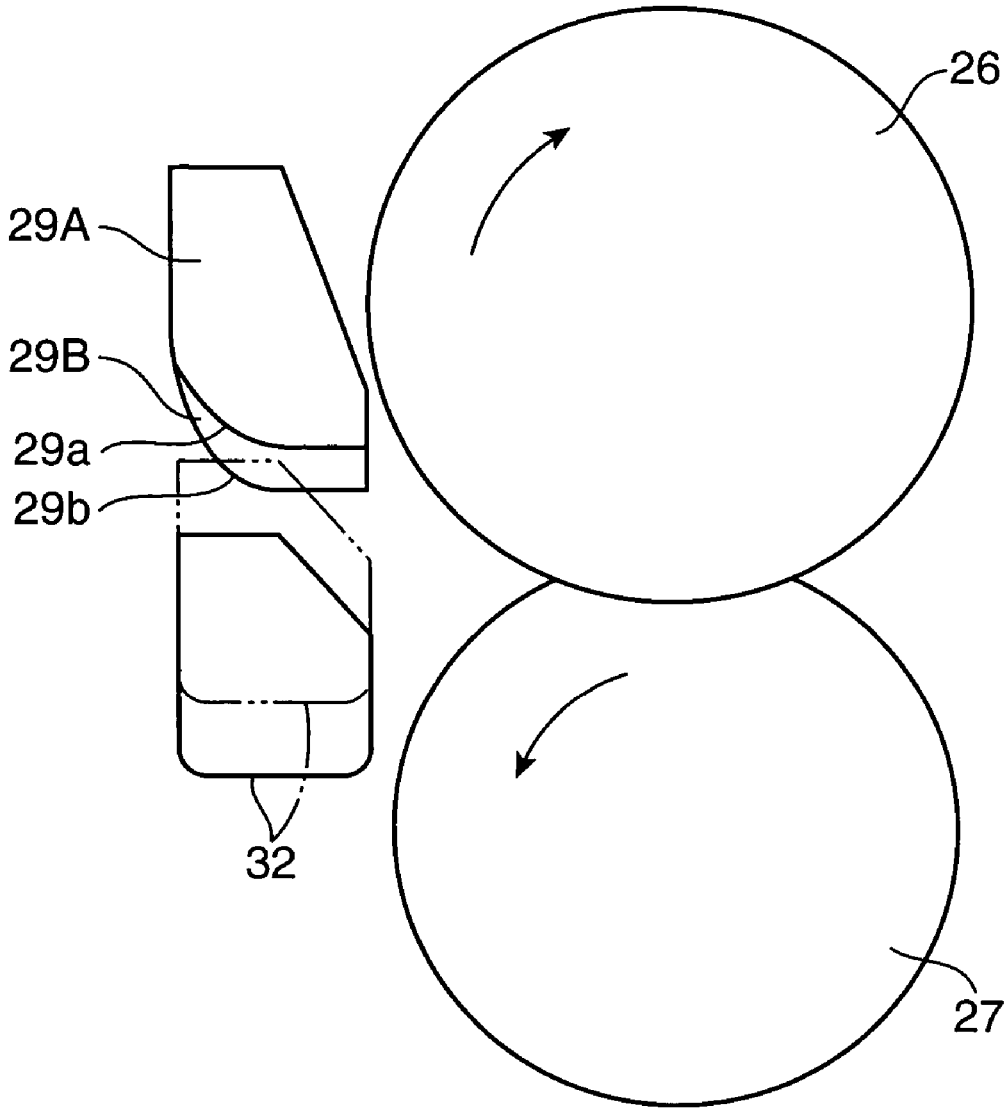
FIG. 3 is a side view showing a positional relationship of a guiding member, a deflecting member and a heating member.

Each guiding plate 29A has a guiding surface 29*a* as shown in FIGS. 2A, 3 and 4A. The guiding plates 29A are able to come in contact with the first recording sheet P1 at the respective guiding surfaces 29*a* to guide the first recording sheet P1 from the fixing section 7 to the upper discharging portion 9. Similarly, each guiding plate 29B has a guiding surface 29 as shown in FIGS. 2A, 3 and 4A. The guiding plates 29B are able to come in contact with the second recording sheet P2 at the respective guiding surfaces 29*b* to guide the second recording sheet P2 from the fixing section 7 to the discharging portion 9.

Each guiding surface 29*a* of the respective guiding plate 29 is farther from the pressing member 27 than each guiding surface 29*b* of the respective guiding plate 29B is. In other words, the level of the guiding surface 29*a* indicated by one-dotted chain line H1 in FIG. 4A is higher than that of the guiding surface 29*b* indicated by one-dotted chain line H2 in FIG. 4A. These two levels are provided with a difference T therebetween.

In the area A2 corresponding to the outside areas at the both sides of the area A1, separating claws 31 are provided. The separating claws 31 are provided near the heating member 26 downstream from the heating member 26 as shown in FIGS. 2A, 3 and 4A, and each separating claw 31 functions as a recording sheet separating member for separating the widthwise opposite ends of the second recording sheet P2 from a peripheral surface of the heating member 26.

The image forming apparatus according to the embodiment is of a center-aligning type in which a widthwise position of the recording sheet P is determined on the basis of the central position. In this type, the above-mentioned area A1 is widthwise centered. On the other hand, in the image forming apparatus of a end-aligning type in which a widthwise position of the recording sheet P is determined on the basis of one of the opposite ends, the area A1 is right-sided or left-sided.

The present invention is also applicable to the second type with the guiding plate 29A provided in the area A1 and the guiding plate 29B provided in the area A2 excluding the area A1, namely, in the area opposite to the area A1.

Since the second recording sheet P2 is wide and thin as compared to the first recording sheet P1, the second recording sheet P2 is less easily separated from the heating member 26. Thus, forced separation of the second recording sheet P2 from the heating member 26 with the separating claws 31 decreases a possibility of occurrence of deficiency in conveyance.

Figure 4B:
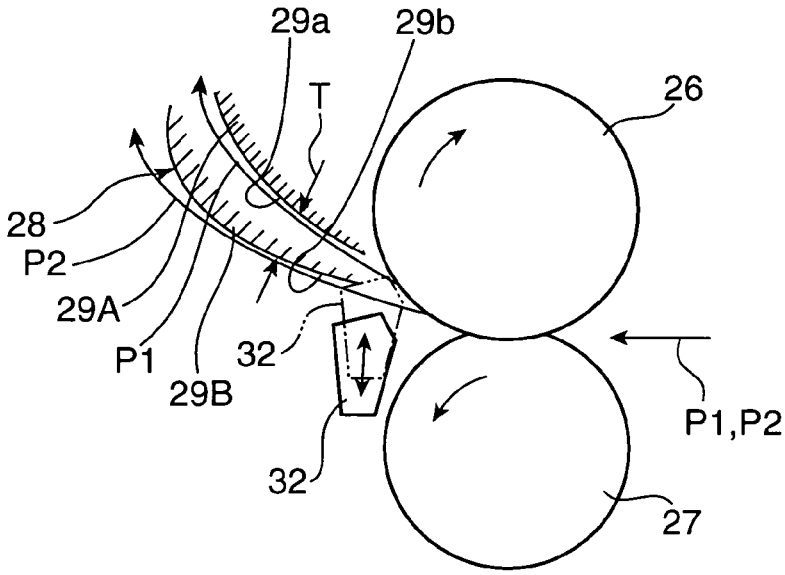
FIG. 4B is a side view showing one type of the guiding member which guides a recording sheet upward.

Further, as shown in FIGS. 2 to 4, a pair of deflecting members 32 is respectively provided in the both sides of the area A1. The deflecting members 32 have a deflecting position indicated by two-dotted chain line in FIGS. 3 and 4B and a retreated position indicated by solid line in FIGS. 3 and 4B, and vise versa. In the deflecting position, the deflecting members 32 are close to the bottom peripheral surface of the heating member 26 and deflect a conveyance direction of the recording sheet P1 conveyed along the peripheral surface of the heating member upward, namely, toward the guiding surface 29*a* of the guiding plate 29A. On the other hand, in the retreated position, the deflecting members 32 are retreated from the deflecting position to under side (namely, to the side of the pressing member 27) so as to avoid contact with the second recording sheet P2.

The deflecting members 32 are vertically movable, held by a frame 33 shown in FIGS. 2A and 2B and supported by an operating member 34 from under side. The frame 33 has guiding holes 33*a* which penetrate through the frame 33 vertically. The deflecting members 32 are respectively placed in the guiding holes 33*a*.

Positions of the deflecting members 32 can be switched by a manual switching member 35 and the operating member 34. The manual switching member 35 is provided in an external surface of the apparatus main body 2 and is manually operated by a user. The operating member 34 constitutes an interlocking mechanism which interlocks the operation of the manual switching member 35 and the deflecting member 32 to thereby switch positions of the deflecting members 32.

The operating member 34 includes a main body shaft 34*b* and is attached to the apparatus main body 2 in such a manner that the main body shaft 34*b* extends horizontally in width direction of the recording sheet P and is rotatable about the main body shaft 34*b*. A pair of levers 34*a* extends from one end of the main body shaft 34*b* upstream in a recording sheet conveyance direction. The levers 34*a* support the respective deflecting member 32 from a lower side. The manual switching member 35 is connected to the other end of the main body shaft 34*b*. The manual switching member 35 is operated to rotate the main body shaft 34*b* and the levers 34*a* integrally for switching a position of the levers 34*a* between a horizontal position as shown by solid line in FIG. 2B and an upward position as shown by two-dotted line in FIG. 2B. The levers 34*a* in the horizontal position support the deflecting members 32 at the retreated position. The levers 34*a* in the upward position support the deflecting members 32 at the deflecting position when the levers 34 are in the upward position.

It should be noted that, the present invention may include a deflecting member unlike a block-shaped deflecting member such as the deflecting member 32 as shown in the figures. For example, it may be a roller which is rotatable about an axis extends in width direction of the recording sheet.

Next, an operation of the apparatus is described.

The recording sheet P on which a toner image has been transferred in the image forming section 6 is nipped between the heating member 26 and the pressing member 27 of the fixing section 7 to be heated for heat-fixing the toner image. The recording sheet P with the heat-fixed toner image is conveyed from the fixing section 7, passes through the guiding portion 28 and is discharged to the discharge portion 9.

Herein, in the case where the recording sheet P is the first recording sheet P1 (for example, a pasteboard-like postcard), the first recording sheet P1 is so firm that the first recording sheet P1 is curved toward the heating member 26 from contact with the heating member 26. Consequently, the first recording sheet P1 is discharged from the fixing section 7 in obliquely upward direction (namely, toward the guiding plate 29A). Further, if the deflecting members 32 are switched to the deflecting position, the deflecting member 32 actively deflects a conveyance of the first recording sheet P1 upward to assure the discharge of the first recording sheet P1 toward the guiding plate 29A. The first recording sheet P1 is guided to the upper discharge portion 9 while being in contact with the guiding surface 29*a* of the guiding plate 29A.

On the other hand, in the case where the recording sheet P is the second recording sheet P2 (for example, an A4-sized normal recording sheet), the second recording sheet P2 is also discharged in an obliquely upward direction while being curved toward the heating member 26 from contact with the heating member 26, but the conveyance path of the second recording sheet P2 is corrected to be lower than the conveyance path of the first recording sheet P1. This correction is performed by the guiding plates 29B, provided in opposite sides of the area A2 occupied by the conveyance path of the second recording sheet, having the guiding surfaces 29*b* at a lower position than the position of the guiding surfaces 29*a* of the guiding plates 29A (namely, near the side of the pressing member 27). The correction makes the contact length of the second recording sheet P2 with the peripheral surface of the heating member 26 shorter than the contact length of the first recording sheet P1 with the peripheral surface of the heating member 26 (i.e. the contact length along a conveyance direction of the first recording sheet P1).

Such a difference of the contact lengths compensates for a difference in temperature rise between the recording sheets P1 and P2 occurred due to the difference between thicknesses of the recording sheet P1 and P2. More particularly, the larger thickness of the recording sheet P1 than that of the second recording sheet P2 suppress a rise in temperature of the recording sheet P1 due to the contact with the heating member 26, while the large contact length of the first recording sheet P1 with the heating member 26 allows the first recording sheet P1 to receive more heat from the heating member 26 than the second recording sheet P2 does. This prevents a trouble of insufficient fixing to the first recording sheet P1. On the contrary, the less thickness of the second recording sheet P2 than that of the first recording sheet P1 hasten a rise in temperature due to the contact with the heating member 26, while the small contact length of the second recording sheet P2 with the heating member 26 allows the second recording sheet P2 to receive less heat from the heating member 26 than the first recording sheet P1 does. This prevents a trouble due to an excessive heating, such as deficiency in separation of the second recording sheet P2 from the heating member 26 or occurrence of an offset.

Accordingly, this apparatus can apply favorable fixing processes to both the recording sheets P1, P2 without especially changing a heating temperature of the heating member 26.

Further, while the second recording sheet P2 is under a process, a contact between the deflecting members 32 and the second recording sheet P2 can be avoided by retreating the deflecting member 32 to the retreating position. A user can desirably select the position of the deflecting member 32 by operating the manual switching member 35.

The manual switching member 35 can be replaced with an electric switching device 36, e.g. a solenoid, as shown in FIG. 2A to switch positions of the deflecting members 32. The electric switching device 36 has a movable member 36*a* moved in accordance with a supply of electricity. The movable member 36*a* is connected to the operating member 34 so as to be interlocked with the deflecting member 32. On an external surface of the apparatus main body 2, there is provided a switch for selecting modes, which is operated to switch a supply of electricity to the electric switching device on and off. More particularly, the operating member 34 is provided so that the movable member 36*a* is moved to shift the deflecting member 32 from the deflecting position to the retreating position, and vise versa, for example, when a postcard mode is selected. Such mechanism is convenient in that the positions of the deflecting member 32 can be switched by operation of the switch.

Figure 5A:
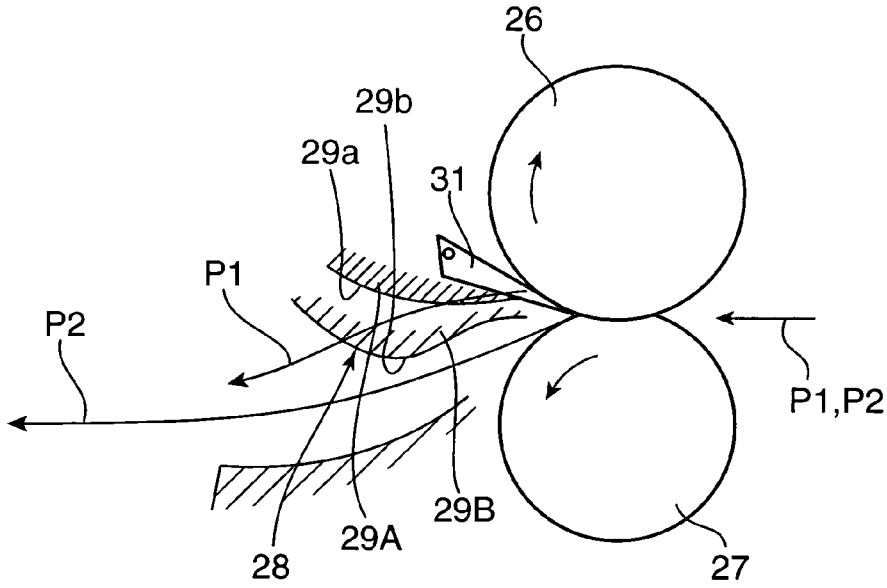
FIG. 5A is a side view showing one type of the guiding member which guides a recording sheet downward.

The FIG. 4B shows, but not limited to, the type of the guiding section 28 which guides the recording sheets P1, P2 upward. For example, as shown in FIG. 5A, the guiding surfaces 29*a*, 29*b* of the respective guiding plates 29A, 29B may guide the recording sheets P1, P2 downward. This type of the guiding section 28 does not involve the deflecting member 32 especially. Further, the type of the guiding section 28 shown in the FIG. 4B is also capable of performance without the deflecting member 32, if the first recording sheet P1 is so curved as to keep enough contact length with the heating member 26.

Figure 5B:
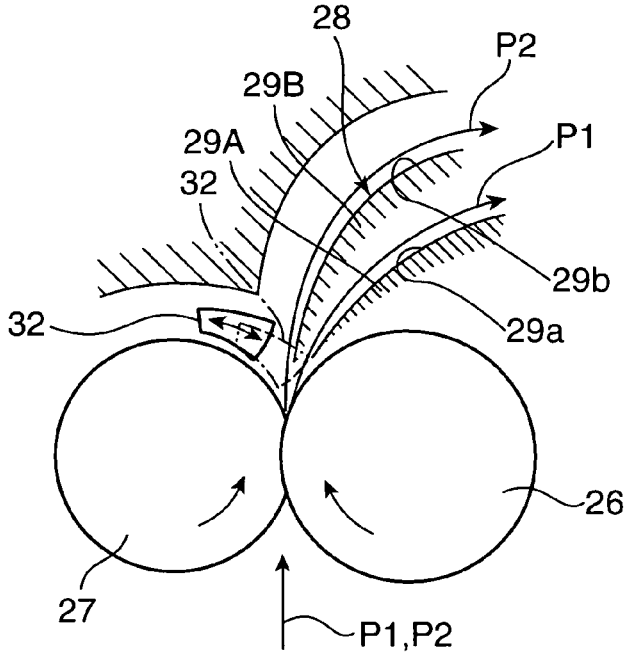
FIG. 5B is a side view showing type of the guiding member which conveys the recording sheet vertically and discharges the recording sheet to a middle discharge portion.

Further, as shown in FIG. 5B, the guiding section 28 can be adapted to a type of an image forming apparatus which conveys the recording sheets P1, P2 vertically and discharges the recording sheets P1, P2 in the middle portion of the apparatus.

Figure 6A:
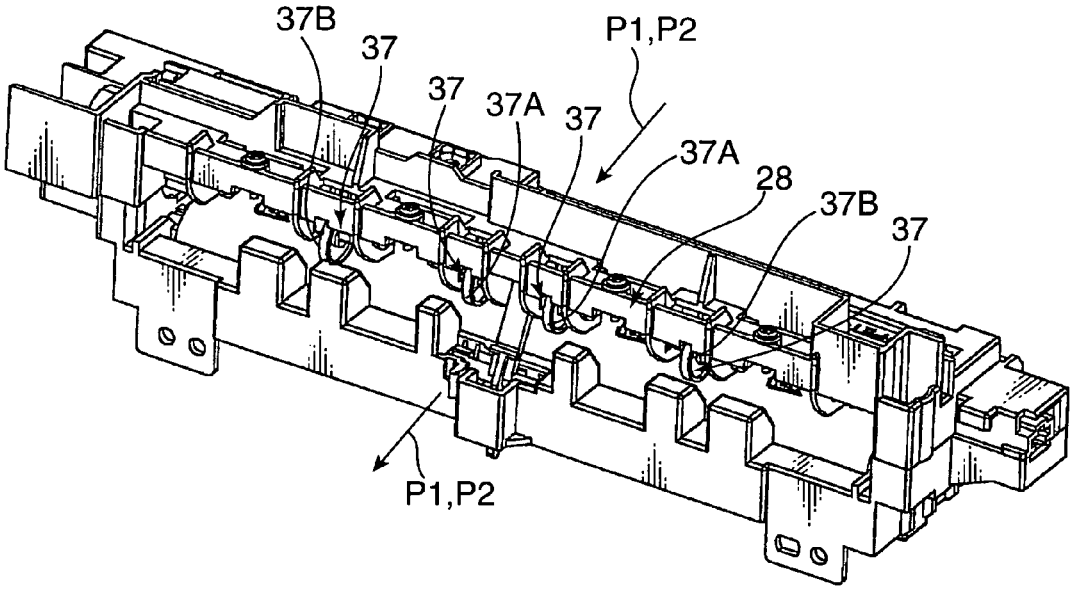
FIG. 6A is a perspective view showing a guiding member constituted by rollers.
Figure 6B:
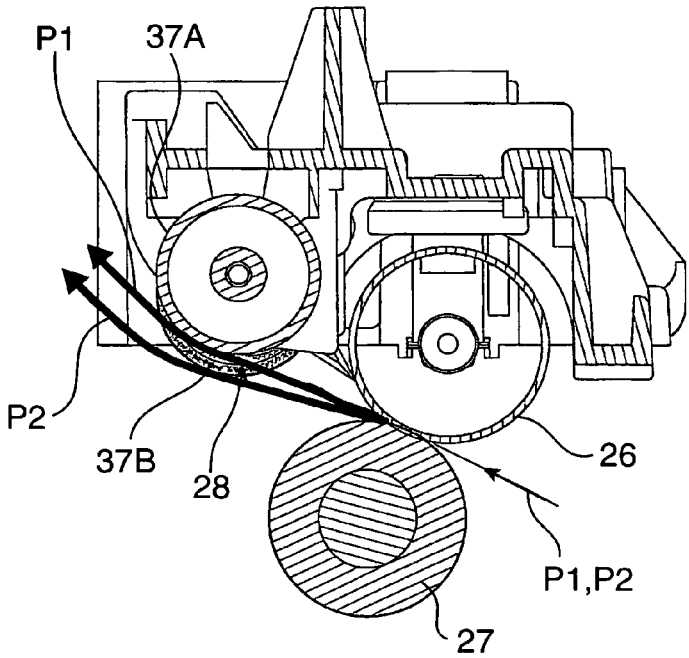
FIG. 6B is a side view showing the rollers.

The first guiding member and the second guiding member in the present invention are not limited to the guiding plates 29A, 29B described above. FIGS. 6A and 6B shows a construction in which the first guiding member consists of a plurality of rollers 37A and the second guiding member consists of a plurality of rollers 37B. All of the shown rollers 37A, 37B are attached rotatably about a common axis, and an outer diameter of each roller 37A corresponding to the first guiding member is smaller than an outer diameter of each roller 37B corresponding to the second guiding member. Such a difference between the outer diameters of the rollers 37A, 37B positions of the bottom surface levels of the rollers 37A (the levels indicated by one-dotted chain line H1 in FIG. 4A) higher than the bottom surface levels of the rollers 37B (the levels indicated by one-dotted chain line H2 in FIG. 4A). Namely, the level of the bottom surface of the roller 37A is farther apart from the pressing member 27 than that of the bottom surface of the roller 37B.

The rollers 37A, 37B is also capable of exerting an effect similar to that described above because the difference between the levels of the bottom surfaces of the rollers 37A, 37B gives a difference between contact lengths of the recording sheets P1, P2 with the heating member 26. Further, since each of the rollers 37A, 37B is rotatable in accordance with the movement of the recording sheets P1, P2 while the peripheral surface of the rollers 37A, 37B is in contact with the recording sheets P1, P2, the contact makes less imprints of grazing on the recording sheets P1, P2 than the sliding contact between the guiding surfaces 29*a*, 29*b* of the above-mentioned guiding plates 29A, 29B and the recording sheets P1, P2.

Further, in the present invention, the conveyance path of the recording sheet P is variable.

As described above, according to the present invention, a guiding section for guiding the recording sheet on which a fixing process has been executed in the fixing section to a predetermined discharging portion includes a first guiding member and a second guiding member. The guiding member comes in contact with the first recording sheet to thereby guide the first recording sheet to the discharging portion. On the other hand, the second guiding member guides the second recording sheet having a second width larger than the first width to the discharge portion in such an angle that the contact length of the second recording sheet with the heating member along a conveyance direction of the second recording sheet is shorter than the contact length of the first recording sheet with the heating member along a conveyance direction of the first recording sheet. Such a difference between the contact lengths enable a favorable heat-fixing process on the recording sheets overcoming a difference in thickness of the first recording sheet and the second recording sheet without changing the temperature of the heating member.

Particularly, it is desirable that the second guiding member provided at a position close to the heating member rather than to the pressing member to correct a conveyance path of the second recording sheet discharged from the fixing section to a side of the heating member toward a position closer to the pressing member than the conveyance path of the first recording sheet.

According to the apparatus, the correction of the conveyance path of the second recording sheet shortens the contact length of the second recording sheet with the heating member as compared with the contact length of the first recording sheet with the heating member.

If the first guiding member and the second guiding member are at a position close to the heating member rather than to the pressing member and the first guiding member is positioned farther apart from the pressing member than the second guiding member is, the first recording sheet is allowed to be discharged closer to the heating member than the second recording sheet is, which keeps a enough contact length with the heating member.

It is preferable that the first guiding member is provided in a central portion in width direction of the recording sheet and the second guiding member is provided in outside areas at the both sides of the first conveyance path. According to this construction, both the first guiding member and the second guiding member can perform guiding of the recording sheet well-balanced in the width direction.

Further, in the image forming apparatus comprising a separating member provided downstream from the heating member in the second conveyance path for separating the second recording sheet from the surface of the heating member, the separating member separates the second recording sheet which is less likely to be separated from the heating member than the first recording sheet to increase assuredness of the conveyance of the first recording sheet.

Further, if the image forming apparatus comprises a deflecting member for deflecting the first conveyance path from the fixing section toward the heating member and the deflecting member has a deflecting position for deflecting the first conveyance path toward the heating member and a retreated position for avoiding contact with the second recording sheet, the deflecting member can deflect the first conveyance path toward the heating member to keep a enough contact length of the first recording sheet with the heating member at the deflecting position for the processing the first recording sheet, while the deflecting member can avoid a contact with the deflecting member at the retreated position for processing the second recording sheet.

A preferable means for switching the position of the deflecting member, for example, comprises a manually operated manual switching member and an interlocking mechanism for switching the position of the deflecting member between the deflecting position and the retreating position, and vise versa by interlocking the manual switching member and the deflecting member, or comprises an electric switching device including a movable member moved by electric power and an interlocking mechanism for switching the position of the deflecting member between the deflecting position and the retreating position, and vise versa by interlocking the movable member of the electric switching device and the deflecting member.

This application is based on patent application No. 2005-187613 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus capable of forming an image onto a first recording sheet having a first width and a first thickness, and a second recording sheet having a second width larger than the first width and a second thickness smaller than the first thickness, the image forming apparatus comprising:

a fixing section including a heating member and a pressing member, the fixing section being adapted for performing a heat-fixing of an image on a recording sheet by nipping the recording sheet between the heating member and the pressing member and heating the recording sheet; and a guiding section including a first guiding member and a second guiding member arranged in a direction of a width of a recording sheet for guiding the recording sheet having been applied with the heat-fixing in the fixing section to a predetermined discharge portion, wherein the first guiding member is provided in a central portion in the direction of the width of the recording sheet in a first conveyance path for the first recording sheet so as to come in contact with the first recording sheet to thereby guide the first recording sheet to the discharge portion; and the second guiding member is provided in outside areas at both sides of the first conveyance path in the direction of the width of the recording sheet in a second conveyance path for the second recording sheet separate from the first conveyance path so that only the second guiding member comes in contact with the second recording sheet to thereby guide the second recording sheet to the discharge portion in such an angle that a contact length of the second recording sheet with the heating member along a conveyance direction of the second recording sheet is shorter than a contact length of the first recording sheet with the heating member along a conveyance direction of the first recording sheet.

2. An image forming apparatus according to claim 1, wherein the second guiding member is provided at a position closer to the heating member than to the pressing member so as to cause the second conveyance path to be closer to the pressing member than to the first conveyance path.

3. An image forming apparatus according to claim 2, wherein the first guiding member and the second guiding member are provided at a position closer to the heating member than to the pressing member, and the first guiding member is farther apart from the pressing member than the second guiding member.

4. An image forming apparatus according to claim 1, further comprising a separating member provided downstream from the heating member in the second conveyance path, the separating member being adapted for separating the second recording sheet from a surface of the heating member.

5. An image forming apparatus according to claim 1, further comprising a deflecting member for deflecting the first conveyance path from the fixing section toward the heating member, wherein the deflecting member has a deflecting position for deflecting the first conveyance path toward the heating member and a retreat position for avoiding contact with the second recording sheet.

6. An image forming apparatus according to claim 5, further comprising:

a manual switching member to be operated manually; and an interlocking mechanism for interlocking the manual switching member and the deflecting member to switch the position of the deflecting member between the deflecting position and the retreat position, and vice versa.

7. An image forming apparatus according to claim 5, further comprising:

an electric switching device including a movable member, the movable member being moved by electric power; and an interlocking mechanism for interlocking the movable member and the deflecting member to switch the position of the deflecting member between the deflecting position and the retreat position, and vice versa.

8. An image forming apparatus according to claim 1, wherein the first guide member includes a plurality of guide plates which are provided along a width of the first recording sheet, each guide plate having a guide surface operable to come into contact with the first recording sheet.

9. An image forming apparatus according to claim 1, wherein the first guiding member includes a roller which is able to come into contact with the first recording sheet and to rotate in accordance with a movement of the first recording sheet.

10. An image forming apparatus according to claim 1, wherein the second guide member includes a plurality of guide plates which are provided along a width of the second recording sheet, each guide plate having a guide surface operable to come into contact with the second recording sheet.

11. An image forming apparatus according to claim 1, wherein the second guiding member includes a roller which is able to come into contact with the second recording sheet and to rotate in accordance with a movement of the second recording sheet.

12. The image forming apparatus of claim 1, wherein the first guiding member is spaced inwardly from opposite widthwise ends of the guiding section and does not overlap with the second guiding member in the direction of the width of the recording sheet.

* * * * *